US009919900B2

(12) United States Patent
St. Pierre et al.

(10) Patent No.: US 9,919,900 B2
(45) Date of Patent: Mar. 20, 2018

(54) BEDPLATE FOR ELEVATOR SYSTEM

(71) Applicant: Otis Elevator Company, Farmington, CT (US)

(72) Inventors: Bruce St. Pierre, Unionville, CT (US); Bruce P. Swaybill, Farmington, CT (US); Kiron Bhaskar, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/039,079

(22) PCT Filed: Nov. 25, 2013

(86) PCT No.: PCT/US2013/071640

§ 371 (c)(1),
(2) Date: May 25, 2016

(87) PCT Pub. No.: WO2015/076837

PCT Pub. Date: May 28, 2015

(65) Prior Publication Data

US 2016/0362279 A1 Dec. 15, 2016

(51) Int. Cl.
*B66B 11/00* (2006.01)
*B66B 7/08* (2006.01)
(Continued)

(52) U.S. Cl.
CPC ..... *B66B 11/004* (2013.01); *B66B 7/08* (2013.01); *B66B 9/00* (2013.01); *B66B 15/04* (2013.01)

(58) Field of Classification Search
CPC ..... B66B 11/004; B66B 7/08; B66B 9/00; B66B 15/04
See application file for complete search history.

(56) References Cited

U.S. PATENT DOCUMENTS 4,977,980 A * 12/1990 Hifumi ..... B66B 11/0273 187/253
5,533,595 A * 7/1996 Narumi ..... B66B 7/06 187/260
(Continued)

FOREIGN PATENT DOCUMENTS

EP 1641701 B1 3/2012
JP 2012153493 A 8/2012
(Continued)

OTHER PUBLICATIONS

International Search Report for application PCT/US2013/071640, dated Aug. 22, 2014, 10 pages.
(Continued)

*Primary Examiner* — Michael A Riegelman
(74) *Attorney, Agent, or Firm* — Cantor Colburn LLP

(57) ABSTRACT

A support member configured for use in a machine room of an elevator system is provided including a base having a car end and a counterweight end. The counterweight end is arranged substantially parallel to a wall of the machine room, and the counterweight end is arranged at an angle relative to the car end. An idler sheave having a plurality of grooves is mounted to the base in an orientation generally parallel to the car end. The idler sheave is configured to rotate about a first axis of rotation. A plurality of individual sheaves is mounted to the based in a staggered configuration substantially complementary to the angle of the counterweight end relative to the car end. Each individual sheave is configured to rotate about a second axis of rotation parallel to the first axis of rotation.

17 Claims, 6 Drawing Sheets

(51) Int. Cl.
*B66B 9/00* (2006.01)
*B66B 15/04* (2006.01)

(56) References Cited

U.S. PATENT DOCUMENTS 6,626,266 B2 * 9/2003 Hamaguchi ..... B66B 11/0045 187/251
7,077,241 B1 * 7/2006 Liebetrau ..... B66B 11/008 187/251
7,261,187 B2 * 8/2007 Fischer ..... B66B 11/00 187/264
8,172,041 B2 * 5/2012 Kawasaki ..... B66B 11/0045 187/254
9,580,277 B2 * 2/2017 Metsanen ..... B66B 11/0206
2004/0129501 A1 * 7/2004 Wittur ..... B66B 11/008 187/254
2004/0182651 A1 9/2004 Ishii et al.
2006/0042882 A1 * 3/2006 Swaybill ..... B66B 7/08 187/254
2006/0042885 A1 * 3/2006 Kawasaki ..... B66B 11/08 187/406
2006/0163009 A1 * 7/2006 Ishii ..... B66B 11/008 187/351
2006/0175139 A1 8/2006 Stocker et al.
2006/0260879 A1 11/2006 Fischer et al.
2008/0289908 A1 11/2008 Muaro et al.
2010/0084224 A1 4/2010 Hao
2011/0315489 A1 * 12/2011 Nakamori ..... B66B 7/1215 187/391

FOREIGN PATENT DOCUMENTS

WO 2011051559 A1 5/2011
WO 2011072113 A1 6/2011
WO 2013110861 A1 8/2013

OTHER PUBLICATIONS

EP Communication; Extended European Search Report; Application No. 13897748.3-1731/307434 PCT/US2013071640; dated Jun. 13, 2017, pp. 1-8.
IPRP, International Application No. PCT/US2013/071640; International Filing Date: Nov. 25, 2013; dated May 31, 2016, pp. 1-6.

* cited by examiner

BEDPLATE FOR ELEVATOR SYSTEM

BACKGROUND OF THE INVENTION

Embodiments of the invention relate to elevator systems, and more particularly, to a bedplate for mounting a machine in a machine room of an elevator system.

Vertical travel of an elevator car is typically powered by a drive assembly that may be supported within an upper portion of an elevator hoistway by a support member, such as a bedplate for example. The drive assembly generally includes a traction machine composed of a gearless motor and a traction sheave, both of which may be mounted on a surface of the bedplate. Rotational torque generated by the motor is used to drive the traction sheave. Depending on the direction of rotation of the motor the traction sheave causes tension members to lift or lower the elevator car and counterweight vertically through the hoistway.

In conventional elevator systems, the counterweight is commonly positioned directly behind the elevator car, centered with the elevator car, or to the side of the elevator car. However, older elevator system may have an asymmetrical layout, where the counterweight is not generally centered relative to the car. To modernize these older elevator systems using existing bedplate structures, a time consuming and costly relocation of the counterweight is required.

BRIEF DESCRIPTION OF THE INVENTION

According to one embodiment of the invention, a support member configured for use in a machine room of an elevator system is provided including a base having a car end and a counterweight end. The counterweight end is arranged substantially parallel to a wall of the machine room, and the counterweight end is arranged at an angle relative to the car end. An idler sheave having a plurality of grooves is mounted to the base in an orientation generally parallel to the car end. The idler sheave is configured to rotate about a first axis of rotation. A plurality of individual sheaves is mounted to the based in a staggered configuration substantially complementary to the angle of the counterweight end relative to the car end. Each individual sheave is configured to rotate about a second axis of rotation parallel to the first axis of rotation.

Additionally or alternatively, the invention may incorporate one or more of the following features individually or in various combinations:

- each individual sheave is configured to rotate about a substantially vertical third axis of rotation;
- the angle of the counterweight end relative to the car end is in a range of greater than zero degrees to about forty degrees;
- a distance between the idler sheave and each individual sheave gradually increases from a first end of the counterweight end to a second, opposite end of the counterweight end;
- at least one of the individual sheaves is aligned with one of the plurality of grooves of the idler sheave;
- at least one individual sheave is mounted within a hollow interior of the base;
- at least one individual sheave is mounted to an upper surface of the base;
- the idler sheave is mounted within the hollow interior of the base;

- a plurality of car dead end hitches are mounted to the car end of the base and a plurality of counterweight dead end hitches are mounted to the counterweight end of the base;
- a machine connected to the base in an orientation substantially parallel to the car end and a traction sheave mounted to the machine, the traction sheave including a plurality of grooves; and/or
- at least one of the plurality of grooves of the idler sheave being generally aligned with at least one of the plurality of grooves of the tractions sheave.

According to another embodiment of the invention, an elevator system is provided including a hoistway having a machine room arranged at a first end. A car is coupled with at least one car guide rail for movement in the hoistway. A counterweight is coupled with at least one counterweight guide rail for movement in a hoistway. A support member positioned within the machine room includes a base having a car end and an opposite counterweight end. The counterweight end is positioned substantially parallel to a wall of the machine room. The counterweight end is arranged at an angle relative to the car end. An idle sheave having a plurality of grooves is mounted to the base in an orientation generally parallel to the car end. The idler sheave is configured to rotate about a first axis of rotation. A plurality of individual sheaves is mounted to the base in a staggered configuration complementary to the angle of the counterweight end relative to the car end. Each individual sheave is configured to rotate about a second axis of rotation parallel to the first axis of rotation. A machine is connected to the base in an orientation substantially parallel to the car end. The machine includes a traction sheave also having a plurality of grooves. A plurality of tension members are operably coupled to the elevator car and the elevator counterweight. Each tension member is received in one of the grooves of the traction shave, one of the grooves of the idler sheave, and a groove of one of the individual sheaves.

Additionally or alternatively, the invention may incorporate one or more of the following features individually or in various combinations:

- each individual sheave is configured to rotate about a substantially vertical third axis of rotation;
- the angle of the counterweight end relative to the car end is in a range of greater than zero degrees to about forty degrees;
- at least one individual sheave is mounted within a hollow interior of the base;
- at least one individual sheave is mounted to an upper surface of the support member;
- the idler sheave is mounted within the hollow interior of the support member;
- a plurality of car dead end hitches are mounted to the car end of the support member and a plurality of counterweight dead end hitches are mounted to the counterweight end of the support member, the car dead end hitches being configured to receive a first end of the plurality of tension members and the counterweight dead end hitches being configured to receive a second end of the plurality of tension members; and/or
- a tension member monitoring device mounted to the support member and operably coupled to at least one of the first end and the second end of each tension member.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
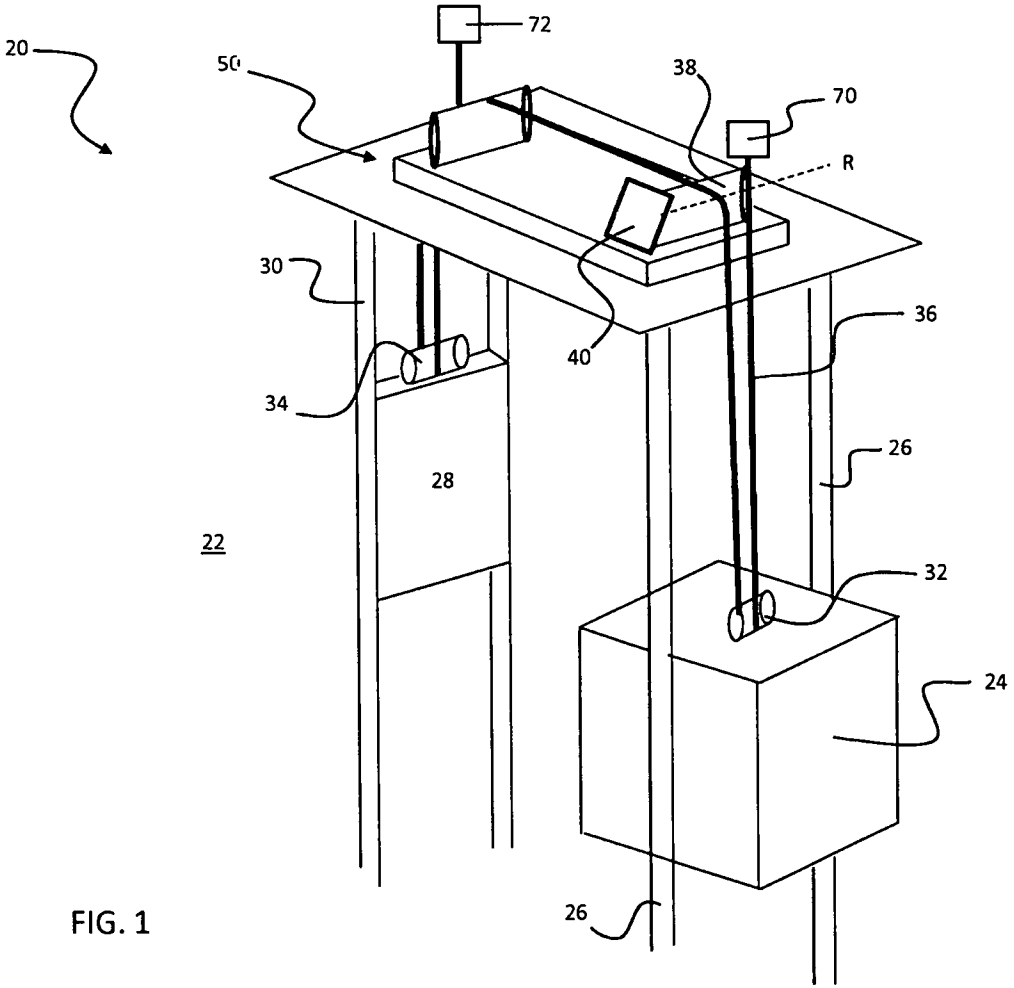
FIG. 1 is a cross-section of an example of an elevator system.

Referring now to FIG. 1, an exemplary elevator system 20 is illustrated. The elevator system 20 includes an elevator car 24 configured to move vertically upwardly and downwardly within a hoistway 22 along a plurality of car guide rails 26. Guide assemblies mounted to the top and bottom of the elevator car 24 are configured to engage the car guide rails 26 to maintain proper alignment of the elevator car 24 as it moves within the hoistway 22.

The elevator system 20 also includes a counterweight 28 configured to move vertically upwardly and downwardly within the hoistway 22. The term counterweight 28 as used herein includes a counterweight assembly that may itself include various components as would be understood by a person skilled in the art. The counterweight 28 moves in a direction generally opposite the movement of the elevator car 24 as is known in conventional elevator systems. Movement of the counterweight 28 is guided by counterweight guide rails 30 mounted within the hoistway 22. In the illustrated, non-limiting embodiment, the elevator car 24 and counterweight 28 include sheave assemblies 32, 34 that cooperate with tension members 36 and a traction sheave 38 mounted to a drive machine 40 to raise and lower the elevator car 24. The drive machine 40 in this exemplary embodiment of the invention is suited and sized for use with flat tension members 36. The sheave assembly 32, shown in FIG. 1, is mounted to the top of the elevator car 24. However, the sheave assemblies 32 may be mounted at another location on the elevator car 24 or elsewhere in the system 20 as recognized by a person skilled in the art.

The drive machine 40 of the exemplary elevator system 20 is positioned and supported at a mounting location atop a support member 50, such as a bedplate for example, in a portion of the hoistway 22 or a machine room. Although the elevator system 20 illustrated and described in herein has an overslung 2:1 roping configuration, elevator systems 20 having other roping configurations and hoistway layouts are within the scope of the invention.

Referring now to FIGS. 2-6, the support member 50 of the elevator system 20 is illustrated in more detail. The generally rectangular support member 50 includes a first car end 52 and a second counterweight end 58 positioned opposite the car end 52. A first connection member 64 couples the first side 54 of the car end 52 to the first side 60 of the counterweight end 58 and a second connection member 66 couples the second side 56 of the car end 52 to the second side 62 of the counterweight end 58. The counterweight end 58 is arranged at an angle θ relative to the car end 52 such that a distance between the first side 54 of the car end 52 and the first side 60 of the counterweight end 58 is less than the distance between the second side 56 of the car end 52 and the second side 62 of the counterweight end 58. The angle of the counterweight end 58 relative to the car end 52 is most clearly shown in the top view of the machine room illustrated in FIG. 6. In one embodiment, the angle θ of the counterweight end 58 relative to the car end 52 is in the range of greater than zero degrees to about forty degrees. As a result, the first connection member 64 is generally shorter in length than the second connection member 66. The counterweight end 58 of the support member 50 is configured to mount substantially parallel to a wall of the hoistway 22 such that the car end 52 of the support member 50 is arranged in the middle of the machine room.

Figure 2:
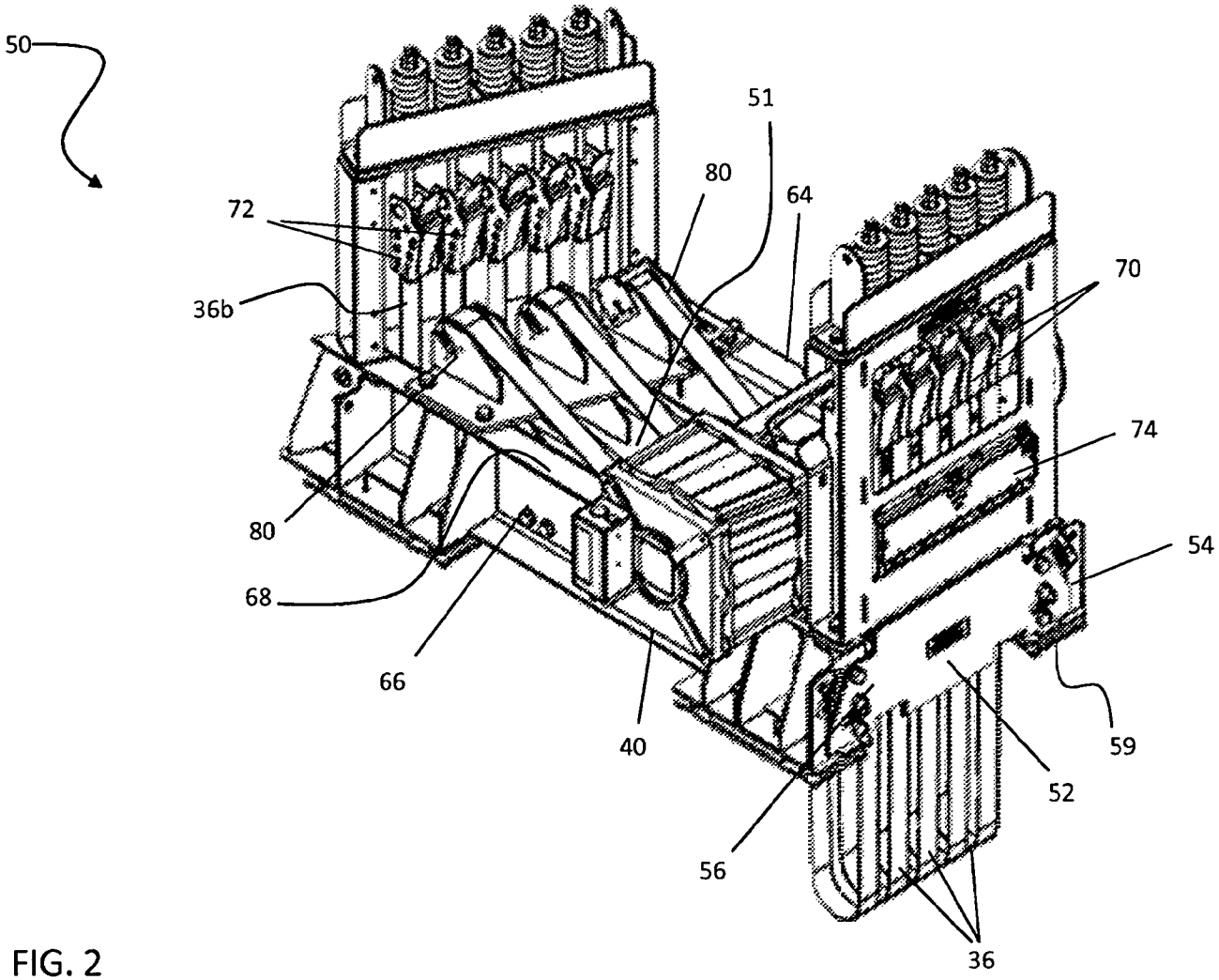
FIG. 2 is a perspective view of a support member of an elevator system according to an embodiment of the invention.
Figure 3:
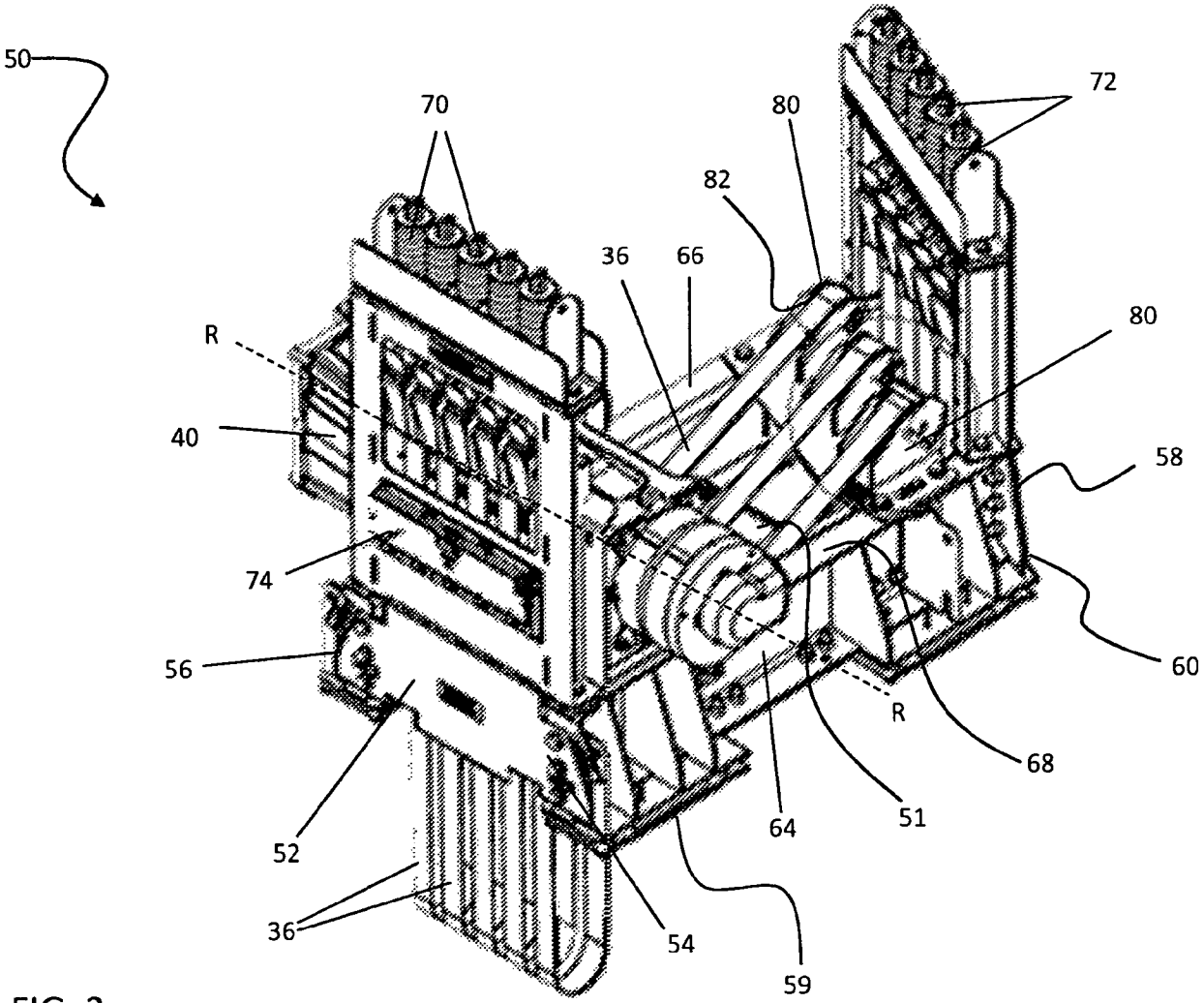
FIG. 3 is another perspective view of a support member of an elevator system according to an embodiment of the invention.
Figure 4:
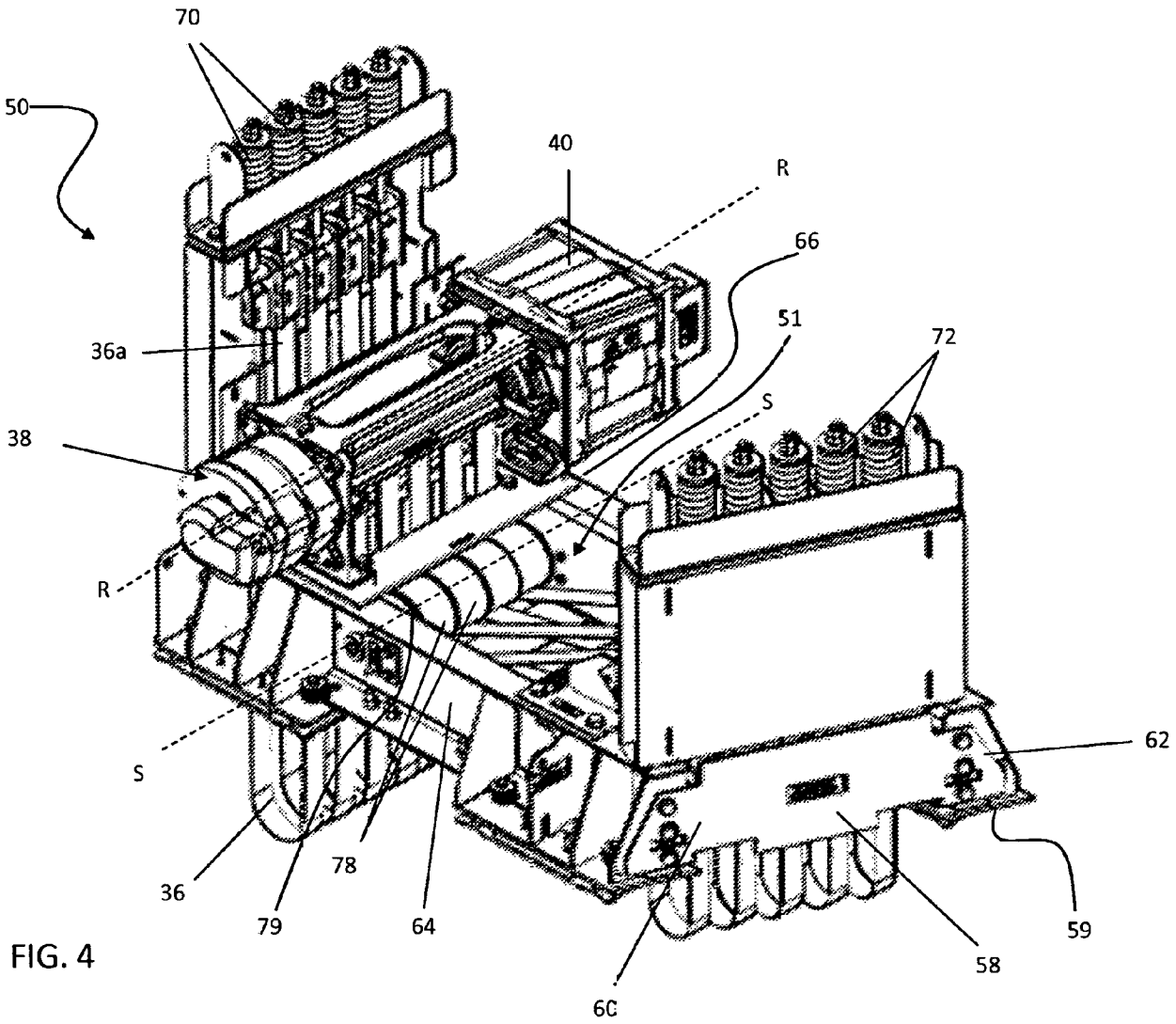
FIG. 4 is an alternate perspective view of a support member of an elevator system according to an embodiment of the invention.

As is known, opposed ends of the tension members 36 are terminated in the elevator system 20 at dead end hitches 70 and 72. A plurality of dead end hitches 70, each being configured to connect to a car-side 36*a* (FIG. 4) of one of the plurality of tension members 36, is mounted generally linearly about the upper surface 68 of the support member 50 adjacent the car end 52. The counterweight dead end hitches 72, each being configured to receive the counterweight-side 36*b* (FIG. 2) of one of the plurality of tension members 36, are similarly mounted about the upper surface 68 of the support member 50 at the counterweight end 58. In the illustrated non-limiting embodiment, the car and counterweight side dead end hitches 70, 72 are spaced vertically above the upper surface 68 of the support member 50. However, in other embodiments, at least a portion of either the car or counterweight-side dead end hitches 70, 72 may extend below a bottom surface 59 of the support member 50 into the hoistway 22. In one embodiment, a tension member monitoring device 74 operably coupled to the car-side and/or the counterweight-side 36*a*, 36*b* of the tension members 36 may be connected to the support member 50, such as behind the car dead end hitches 70 (FIG. 2).

The drive machine 40, configured to rotate about an axis of rotation R, is mounted near the car end 52 of the support member 50 in an orientation substantially parallel thereto. In the illustrated, non-limiting embodiment, the drive machine 40 is mounted to the upper surface 68 of the support member 50; however the drive machine 40 may be arranged at another location about the support member 50, such as within the hollow interior 51 thereof for example. The traction sheave 38 (FIG. 1) mounted concentrically with the shaft of the drive machine 40 includes a plurality of grooves (not shown), each groove being configured to receive one of the plurality of tension members 36. The traction sheave 38 and machine 40 are positioned such that grooves of the traction sheave 38 are generally aligned with the corresponding grooves (not shown) on the car sheave 32 (FIG. 1). In addition, a portion of the circumference of the traction sheave 38 is substantially coplanar with a portion of the circumference of the sheave 32 mounted to the elevator car 24.

An idler sheave 76 having a plurality of grooves 78 and an axis of rotation. S is mounted to the support member 50, parallel to the drive machine 40. In the illustrated, non-limiting embodiment, the idler sheave 76 is arranged in the hollow interior 51 of the support member 50, adjacent the machine 40, such that the tension members 36 extend generally vertically between traction sheave 38 and the idler sheave 74. The idler sheave 76 and the machine may be arranged such that a portion of the circumference of the idler sheave 76 is substantially coplanar with a portion of the circumference of the traction sheave 38. In addition, each of the plurality of grooves 78 of the idler sheave 76 is generally aligned with one of the plurality of grooves of the traction sheave 38. In the illustrated embodiment, tension members 36 are configured to contact the traction sheave 38 around half of the circumference thereof.

A plurality of substantially identical individual sheaves 80 are mounted to the support member 50 adjacent the counterweight side 58. Each individual sheave 80 has a single groove 82 configured to receive one of the plurality of tension members 36. The individual sheaves 80 may be mounted, such as with brackets and a plate for example, to the upper surface 68 of the support member 50, or alternatively, within the hollow interior 51 of the support member 50. In one embodiment, as a result of spatial constraints, at least one of the individual sheaves 80 is mounted to the upper surface 68 of the support member 50 and at least one of the individual sheaves 80 is mounted within the hollow interior 51 of the support member 50.

Figure 5:
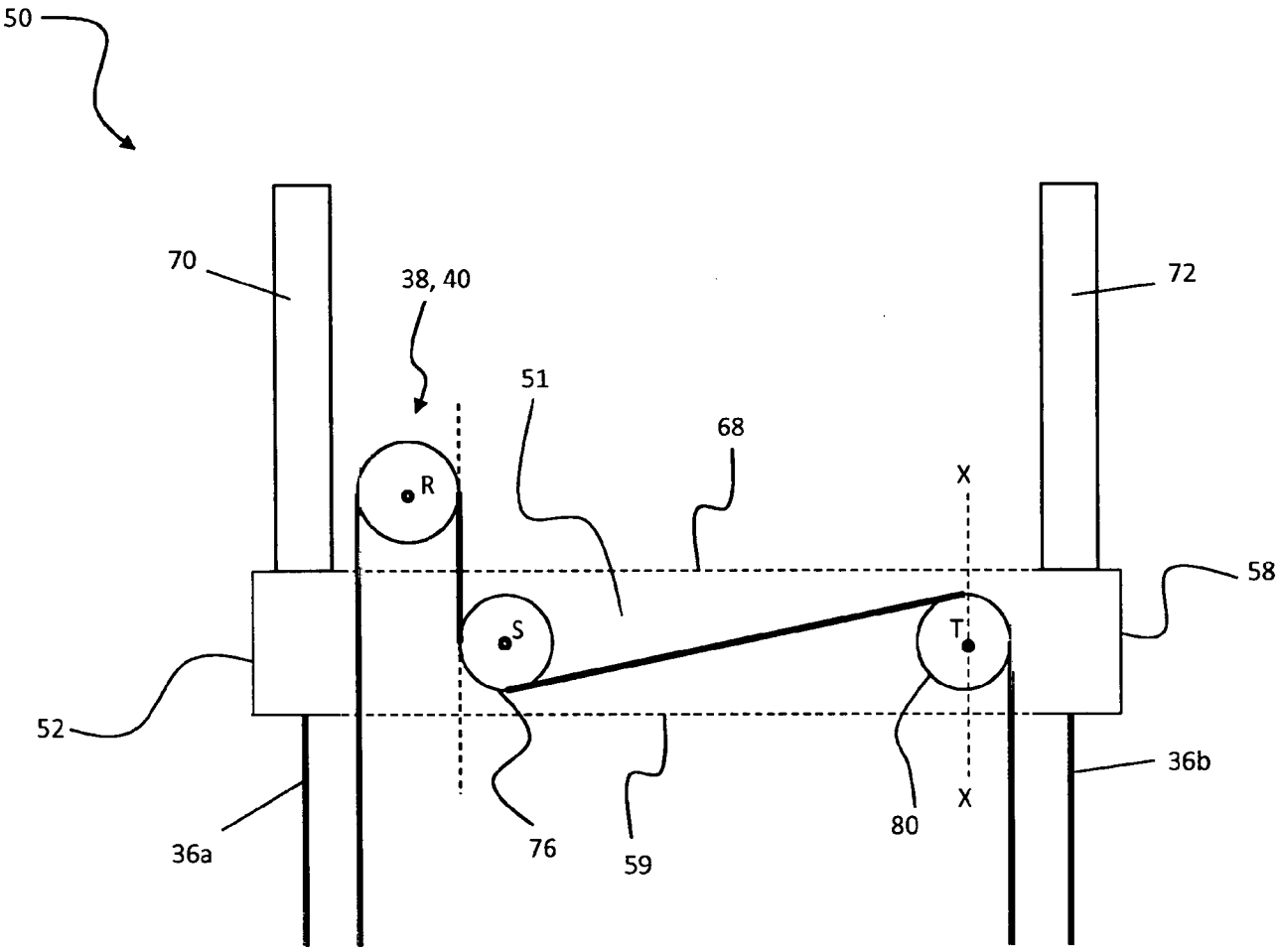
FIG. 5 is a cross-sectional view of a support member of an elevator system according to an embodiment of the invention.
Figure 6:
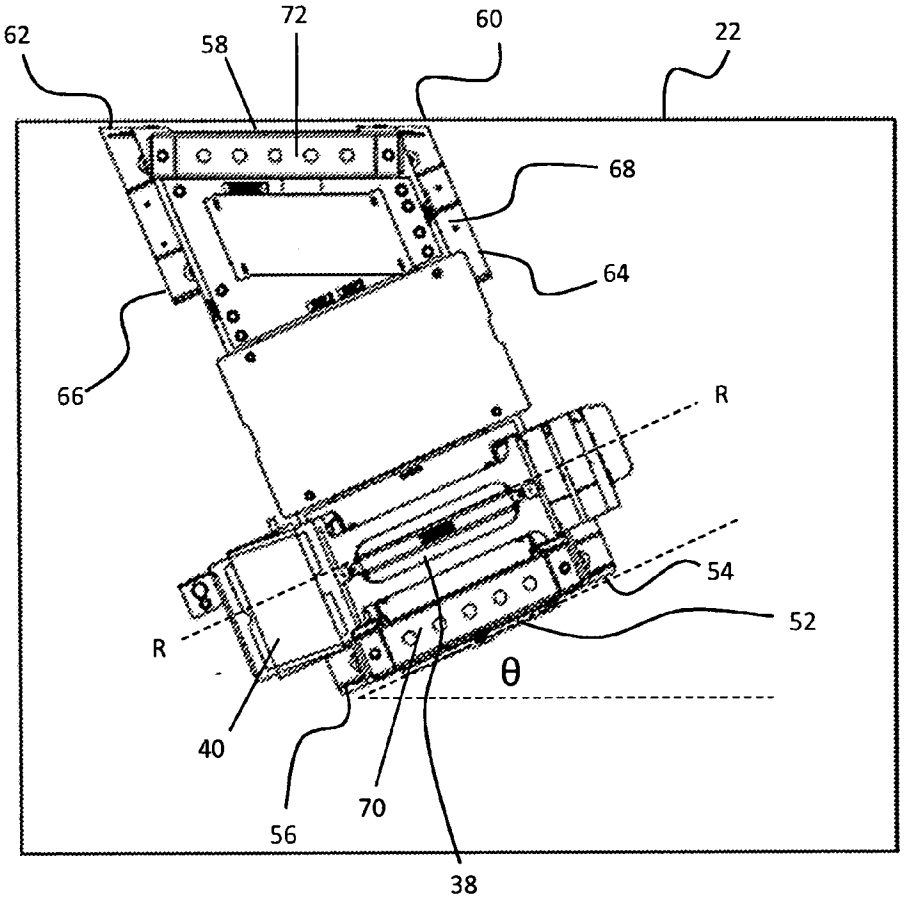
FIG. 6 is a top view of the support member of an elevator system according to an embodiment of the invention.

Each of the individual sheaves 80 is configured to rotate about a first axis of rotation T and a second axis of rotation X (FIG. 5). The first axes of rotation T of the plurality of individual sheaves 80 are substantially parallel to one another and are generally parallel to the axis of rotation R of the drive machine 40 and the axis of rotation. S of the idler sheave 76. The second axes of rotation X are generally vertical such that the each individual sheave 80 is configured to rotate about the planar surface of the support member 50 that the sheaves 80 are mounted to. Each of the plurality of individual sheaves 80 is generally aligned with a corresponding groove 78 of the idler sheave 76. The individual sheaves 80 are arranged in a staggered configuration such that a distance between each sheave 80 and an adjacent counterweight dead end hitch 72 associated therewith is substantially the same. As a result, the distance between the idler sheave 76 and each of the individual sheaves 80 gradually increases from the first side 60 of the counterweight end 58 to the second side 62 of the counterweight end 58.

After wrapping about a quarter of the circumference of the idler sheave 76 and a quarter of the circumference of the individual sheaves 80, the tension members 36 extend vertically to an idler sheave 34 mounted to the counterweight 28, and then back to the support member 50 to connect to dead end hitches 72. The sheaves 80 are generally aligned with grooves (not shown) on the counterweight idler sheave 34. In one embodiment, the individual sheaves 80 and the idler sheave 34 on the counterweight are arranged such that a portion of the circumference of the each sheave 80 is substantially coplanar with a portion of the circumference of the counterweight idler sheave 34. Although the support member 50 is described with a plurality of individual sheaves 80, elevator systems where only some of the sheaves 80 receive a tension member 36 are within the scope of the invention.

By arranging the counterweight side 58 of the support member 50 substantially parallel to an adjacent hoistway wall (FIG. 5) the support member 50 may be easily mounted to the machine room wall. The support member 50 may be shipped partially or fully assembled, including additional components, such as, the idler sheave 76, the individual sheaves 80, the dead end hitches 70, 72, and the tension member monitoring system. Further assembly, such as of the coupled drive machine 40 and traction sheave 38 may be completed once the support member 50 is mounted in the machine room.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A support member configured for use in a machine room of an elevator system, comprising:

a base including a car end and a counterweight end, the counterweight end being arranged substantially parallel to a wall of the machine room, the counterweight end being arranged at an angle relative to the car end;

an idler sheave having a plurality of grooves mounted to the base in an orientation generally parallel to the car end, the idler sheave being configured to rotate about a first axis of rotation; and a plurality of individual sheaves mounted to the base in a staggered configuration substantially complementary to the angle of the counterweight end relative to the car end, each of the plurality of individual sheaves being configured to rotate about a second axis of rotation parallel to the first axis of rotation and about a substantially vertical third axis of rotation.

2. The support member according to claim 1, wherein the angle of the counterweight end relative to the car end of the base is in a range of greater than zero degrees to about forty degrees.

3. The support member according to claim 1, wherein the plurality of individual sheaves are arranged such that a distance between the idler sheave and each of the plurality of individual sheaves gradually increases from a first end of the counterweight end to a second end opposite of the counterweight end.

4. The support member according to claim 1, wherein at least one of the plurality of individual sheaves is aligned with one of the plurality of grooves of the idler sheave.

5. The support member according to claim 1, wherein at least one of the plurality of individual sheaves is mounted within a hollow interior of the base.

6. The support member according to claim 5, wherein the idler sheave is mounted within a hollow interior of the base.

7. The support member according to claim 1, wherein at least one of the plurality of individual sheaves is connected to an upper surface of the base.

8. The support member according to claim 1, further comprising:

a plurality of car dead end hitches mounted to the car end of the base; and a plurality of counterweight dead end hitches mounted to the counterweight end of the base.

9. The support member according to claim 1, further comprising:

a machine connected to the base in an orientation substantially parallel to the car end; and a traction sheave mounted to the machine, the traction sheave including a plurality of second grooves.

10. The support member according to claim 9, wherein at least one of the plurality of grooves of the idler sheave is generally aligned with at least one of the plurality of grooves of the traction sheave.

11. The elevator system according to claim 10, further comprising:

a plurality of car dead end hitches mounted to the car end of the support member, the car dead end hitches being configured to receive a first end of the plurality of tension members; and a plurality of counterweight dead end hitches mounted to the counterweight end of the support member, the counterweight dead end hitches being configured to receive a second end of the plurality of tension members.

12. An elevator system, comprising:

a hoistway having a machine room arranged at a first end;

a car coupled with at least one car guide rail for movement in the hoistway;

a counterweight coupled with at least one counterweight guide rail for movement in the hoistway;

a support member positioned within the machine room, the support member including:

a base including a car end and an opposing counterweight end the counterweight end being arranged substantially parallel to a wall of the machine room and the counterweight end being arranged at an angle relative to the car end;

an idler sheave having a plurality of grooves mounted to the base in an orientation generally parallel to the car end, the idler sheave being configured to rotate about a first axis of rotation; and a plurality of individual sheaves mounted to the base in a staggered configuration substantially complementary to the angle of the counterweight end relative to the car end, each of the plurality of individual sheaves being configured to rotate about a second axis of rotation parallel to the first axis of rotation and about a substantially vertical third axis of rotation;

a machine connected to the base in an orientation substantially parallel to the car end, the machine having a traction sheave including a plurality of grooves mounted thereto; and a plurality of tension members operably coupled to the elevator car and the elevator counterweight, each of the tension members being received in one of the plurality of grooves of the traction sheave, one of the grooves of the idler sheave, and in a groove of one of the plurality of individual sheaves.

13. The elevator system according to claim 12, wherein the angle of the counterweight end relative to the car end of the support member is in the range of greater than zero degrees to about forty degrees.

14. The elevator system according to claim 12, wherein at least one of the plurality of individual sheaves is mounted within a hollow interior of the base.

15. The elevator system according to claim 12, wherein at least one of the plurality of individual sheaves is connected to an upper surface of the base.

16. The elevator according to claim 15, wherein the idler sheave is mounted within a hollow interior of the base.

17. The elevator system according to claim 15, further comprising a tension member monitoring device mounted to the support member and operably coupled to at least one of the first end and the second end of each of the plurality of tension members.

* * * * *